US007263392B2

(12) United States Patent
Akasegawa et al.

(10) Patent No.: US 7,263,392 B2
(45) Date of Patent: Aug. 28, 2007

(54) SUPERCONDUCTOR TRANSMISSION LINE HAVING SLITS OF LESS THAN λ /4

(75) Inventors: Akihiko Akasegawa, Kawasaki (JP); Kazunori Yamanaka, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/203,956

(22) Filed: Aug. 16, 2005

(65) Prior Publication Data

US 2005/0272609 A1 Dec. 8, 2005

Related U.S. Application Data

(63) Continuation of application No. PCT/JP03/02087, filed on Feb. 25, 2003.

(51) Int. Cl.
*H01P 3/06* (2006.01)
*H01B 12/02* (2006.01)

(52) U.S. Cl. ..... 505/210; 333/99 S; 333/222; 333/243; 29/599

(58) Field of Classification Search ..... 333/99 S, 333/222, 243; 505/210; 29/599
See application file for complete search history.

(56) References Cited

U.S. PATENT DOCUMENTS 3,612,742 A 10/1971 Snowden et al.
5,172,085 A * 12/1992 Glenat et al. ..... 333/222
6,083,883 A * 7/2000 Lithgow ..... 505/210
6,470,198 B1 * 10/2002 Kintaka et al. ..... 505/210

FOREIGN PATENT DOCUMENTS

| | | | |
|---|---|---|---|
| JP | 59-132513 | 7/1984 | |
| JP | 63-245823 | 10/1988 | |
| JP | 0044104 | * 2/1989 | ..... 333/227 |
| JP | 11-329106 | 11/1999 | |
| JP | 2001-217608 | 8/2001 | |

OTHER PUBLICATIONS

German Patent Office Action, dated Jan. 4, 2007 , and issued in corresponding German Patent Application No. 103 93 568.1-34.

* cited by examiner

*Primary Examiner*—Benny T. Lee
(74) *Attorney, Agent, or Firm*—Staas & Halsey LLP

(57) ABSTRACT

A transmission line is provided which has a low loss and can flow large current. A superconductor transmission line has: an internal conductor; and an external conductor surrounding the internal conductor, made of oxide superconductor and having four planes, which four planes have a cross section of a hollow quadrilateral with each corner portion being removed, and adjacent planes of which define a slit narrower than λ/4 (λ being a wavelength of a high frequency wave to be transmitted).

18 Claims, 4 Drawing Sheets

SUPERCONDUCTOR TRANSMISSION LINE HAVING SLITS OF LESS THAN λ /4

CROSS REFERENCE TO RELATED APPLICATION

This application is a continuation application of an International patent application PCT/JP03/02087, FILED ON Feb. 25, 2003, the entire contents of which are incorporated by reference.

BACKGROUND OF THE INVENTION

A) Field of the Invention

The present invention relates to a transmission line using oxide superconductor which has a low loss and can accommodate a large current flow therethrough.

B) Description of the Related Art

As a high frequency transmission line, a coaxial transmission line is known which has a grounded external conductor surrounding a central conductor. An electric field is generated from the central conductor toward the grounded external conductor. A magnetic field is generated perpendicular to the direction of the electric field. Current flows along an extension direction of the central conductor and grounded external conductor (along a direction perpendicular to the cross section). Known as conductive material are good electrical conductors such as Cu, Ag and Au, and super conductors. A space between the central conductor and grounded external conductor is filled with air or solid state dielectric (hereinafter simply called dielectric). If dielectric is used, the transmission line can be made more compact than using air. The central conductor may have a hollow structure.

FIGS. 4A to 4C are perspective views schematically showing examples of the structure of a transmission line according to prior art.

In FIG. 4A, a cylindrical central conductor 101 and a grounded tubular external conductor 102 are electrically separated by a dielectric block 104. Material having a small high frequency loss is selected as the dielectric. If material having a high dielectric constant is used, the transmission line can be made compact. The grounded external conductor 102 and central conductor 101 are made of normal conductor such as Cu, Ag and Au. Since current in the central conductor 101 flows in the surface layer, the central conductor 101 may have a tubular hollow structure. In this case, the thickness is set to twice a skin depth or thicker. If the central conductor 101 has the hollow structure, dielectric 103 may be filled in the hollow space.

If the conductor is made of superconductor, a superconductor line has a d.c. resistance of 0 and a very small resistance even at high frequencies. It is therefore possible to form a low loss, large current transmission line. Oxide superconductor enters a superconductive state at a relatively high temperature and is convenient for handling.

Oxide superconductor has the electric characteristics very sensitive to the structure of crystal grain boundaries, as different from metal conductor or the like. Many oxide superconductors have a rectangular solid crystal structure. If there are several degrees between crystal axis directions of adjacent rectangular solids, a crystal grain boundary is formed therebetween.

In the structure shown in FIG. 4A, if the dielectric block 103 is made of single crystal and the grounded external conductor 102 is tried to be formed by epitaxially growing oxide superconductor on the arc outer surface of the dielectric block 103, it is very difficult to epitaxially grow oxide superconductor.

FIG. 4B shows another configuration of a transmission line. On the outer surface of a rectangular prism dielectric block 104 preferably made of single crystal, a grounded external conductor 102 of oxide superconductor is formed. An inner hole having a circular cross section is formed through the dielectric block 104, and a central conductor 101 is accommodated in the inner hole. The central conductor 101 may have a hollow structure, and dielectric 103 may be accommodated in the hollow space. A hollow structure without filling the dielectric may also be adopted.

FIG. 4C shows another configuration of a transmission line. A dielectric block 104 preferably made of single crystal has a rectangular prism shape and a rectangular prism inner hole. On the outer surface of the rectangular prism, a grounded external conductor 102 is formed, and on the inner wall of the rectangular prism inner hole, a central conductor 101 is formed. The central conductor 101 has a hollow structure, and dielectric 103 may be accommodated in the hollow space. The grounded external conductor 102 and central conductor 101 are made of oxide superconductor.

The grounded external conductor 102 shown in FIG. 4B and the central conductor 101 and grounded external conductor 102 shown in FIG. 4C are formed on flat surfaces of the single crystal dielectric blocks 104. However, as an oxide superconductor layer is epitaxially grown, the oxide superconductors on adjacent surfaces contact each other at the edge portion of the rectangular prism. If crystal orientations are different, generation of a crystal grain boundary is inevitable. This crystal grain boundary increases a loss and large current is difficult to be flowed. Although an epitaxial layer or a layer near single crystal can be formed on a flat underlay, it is inevitable that crystal grain boundaries are formed at four edge portions.

SUMMARY OF THE INVENTION

It is an object of the present invention to provide a transmission line using oxide superconductor which has a low loss and can accommodate a large current flow therethrough.

According to one aspect of the present invention, there is provided a superconductor transmission line comprising: an internal conductor; and an external conductor surrounding the internal conductor, made of oxide superconductor and having four planes each having a cross section of a hollow quadrilateral with each corner portion being removed, a slit narrower than λ/4 (λ being a wavelength of a high frequency wave to be transmitted) being formed between adjacent planes.

DESCRIPTION OF THE PREFERRED EMBODIMENTS

FIGS. 1A to 1F are a perspective view and cross sectional views schematically showing the structures of transmission lines according to embodiments of the present invention.

Figure 1A:
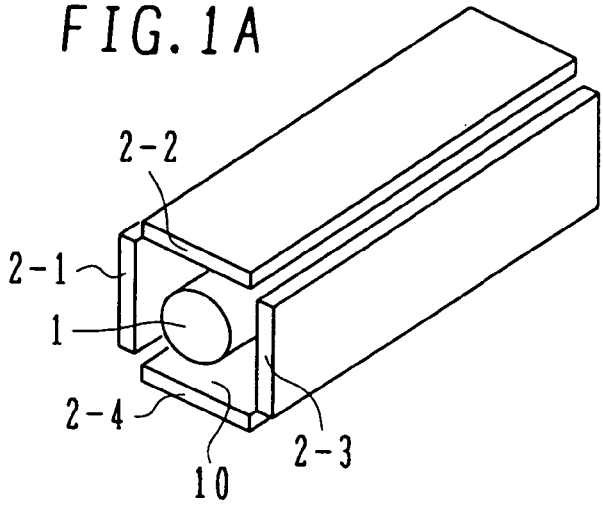
FIGS. 1A-1F are a perspective view and cross sectional views of transmission lines according to embodiments of the present invention.

FIG. 1A shows a first fundamental structure. Four external conductors 42-1, 2-2, 2-3 and 2-4 of planar oxide superconductor layers are disposed surrounding a cylindrical internal conductor 1. A gap 10 is formed between the central conductor 1 and external conductors 42-1, 2-2, 2-3 and 2-4. The four superconductors 2-1, 2-2, 2-3 and 2-4 have a planar shape so that they can be made of oxide superconductor having good crystallinity.

Figure 1B:
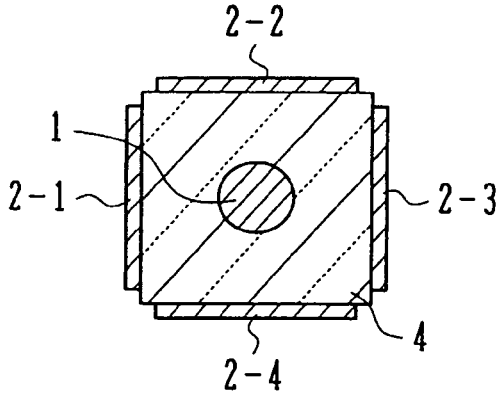

FIG. 1B shows one configuration realizing the structure shown in FIG. 1A. A rectangular prism dielectric block 4 is made of single crystal of low loss, high dielectric constant material such as magnesium oxide (MgO), lanthanum aluminate ($LaAlO_3$) and sapphire ($Al_2O_3$). If sapphire is used, it is preferable to form a buffer layer of $CeO_2$ on the surface of sapphire. For example, an MgO block is used which has a square cross sectional outer periphery, the (1 0 0) plane of each outer peripheral surface, and an inner hole having a circular cross section. On the four flat outer peripheral surfaces, oxide superconductor layers 2-1, 2-2, 2-3 and 2-4 are formed separated from each other. Electric good conductor such as Ag, Au, Cu and Al or a superconductor wire 1 is inserted in the inner hole having the circular cross section.

Figure 1C:
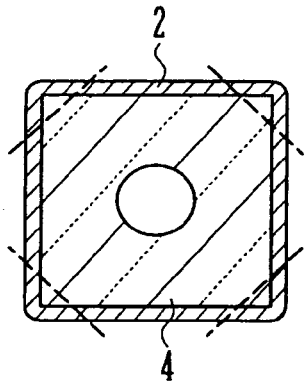

FIG. 1C illustrates a first method of forming the oxide superconductor layers 2-1, 2-2, 2-3 and 2-4 such as shown in FIG. 1B. Oxide superconductor material of a liquid phase is coated by dip coating, screen printing or the like on the outer peripheral surfaces of the single crystal dielectric block 4. It is preferable to select, as oxide superconductor, Bi(Pb)—Sr—Ca—Cu—O, Y—Ba—Cu—O (YBCO), or RE-Ba—Cu—O (where RE is one of La, Nd, Sm, Eu, Gd, Dy, Er, Tm, Yb, and Lu which has stable and good characteristics.

By sintering the oxide superconductor layer 2 at a high temperature, the oxide superconductor layer is solid-phase crystallized and presents superconductivity. In order to have good high frequency characteristics and allow large current, the thickness of the superconductive layer is set to 0.5 μm or thicker. If a liquid material layer dip-coated is sintered, crystal grain boundaries are likely to be formed at each edge portion of a hollow quadrilateral in cross section.

The oxide superconductor layer at the edge portions are removed together with portions of the underlying dielectric block by a mechanical method such as abrading with a file, and cutting with a cutter. By removing the oxide superconductor layer at the edge portions which is likely to have irregular crystallinity, four oxide superconductor layers having good crystallinity are left on the four outer peripheral surfaces of the dielectric block 4. In order to prevent leakage of transmitted high frequency waves, a slit width between adjacent oxide superconductor layers is set narrower than $\lambda/4$ wherein $\lambda$ is the wavelength of a high frequency wave to be transmitted. If there are a plurality of wavelengths, the shortest wavelength is used. If dielectric exists between the inner conductor and external conductor, the wavelength to be used is an effective wavelength in the space where a high frequency wave exists.

Instead of dip coating and printing, sputtering in a vacuum vessel, vapor deposition (including laser co-deposition and deposition) may be used for forming the oxide superconductive layer on the outer peripheral surfaces of the dielectric block. Although this method takes a film forming time and requires expensive facilities, a film can be grown at an atomic level and an epitaxial layer of very high quality can be formed. Similar to the above description, each edge portion of the oxide superconductor layer of a hollow quadrilateral in cross section is removed.

Figure 1D:
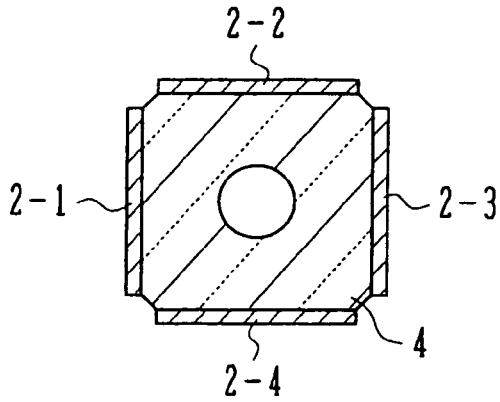

FIG. 1D illustrates a second method of forming separated oxide superconductor layers. Each edge portion of the quadrilateral in cross section of a dielectric block 4 is chamfered. Oxide superconductor material layers are coated through printing on the outer peripheral flat surfaces of the dielectric block 4. By sintering the oxide superconductor material layers at a high temperature, four oxide superconductor layers 2-1, 2-2, 2-3, and 2-4 can be formed.

Figure 1E:
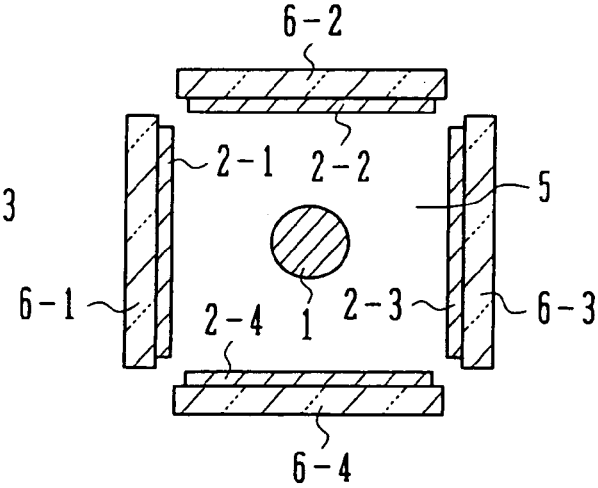

FIG. 1E shows a third configuration of a transmission line. Four grounded external conductors 2-1, 2-2, 2-3 and 2-4 are disposed facing a central conductor 1 via an air gap 5. The four oxide superconductor layers 2-1, 2-2, 2-3 and 2-4 may be made of a plate member or may be formed on plate support substrates 6-1, 6-2, 6-3 and 6-4 as shown in FIG. 1E.

The plate support substrates 6-1, 6-2, 6-3 and 6-4 are preferably made of material on which an oxide superconductor layer can be epitaxially grown. Such material includes magnesium oxide, lanthanum aluminate, sapphire, strontium oxide, cerium oxide, titanium oxide, silver, gold, nickel, nickel oxide and nickel alloy. If the oxide superconductor layer is formed in a film shape, the film thickness is preferably set to 0.5 μm or thicker in order to obtain good high frequency characteristics and large current.

Figure 1F:
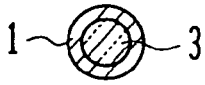

As shown in FIG. 1F, the central conductor 1 may have a hollow structure. In this case, a dielectric block 3 may be disposed in the hollow structure.

FIGS. 2A to 2D show other embodiments of a transmission line.

Figure 2A:
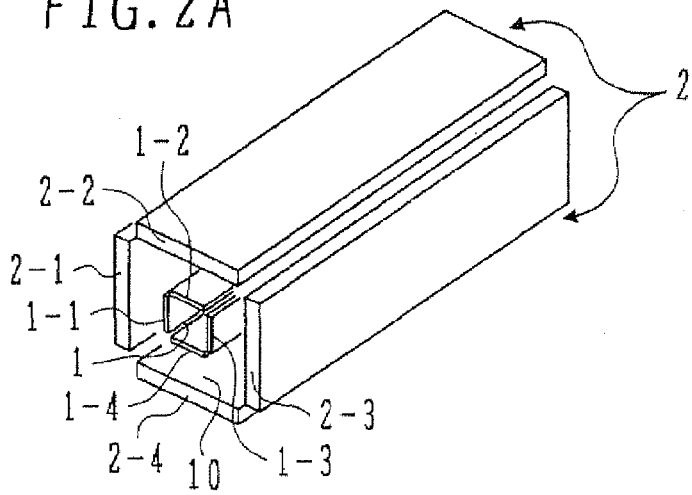
FIGS. 2A-2D are a perspective view and cross sectional views of transmission lines according to other embodiments of the present invention.

FIG. 2A shows a second fundamental structure. A central conductor 1 is constituted of four flat planar oxide superconductor layers 1-1, 1-2, 1-3 and 1-4, and a grounded external conductor 2 is also constituted of four flat planar oxide superconductor layers 2-1, 2-2, 2-3 and 2-4. A gap 10 is formed between the plate type central conductor 1 and the plate type external conductor 2.

Figure 2B:
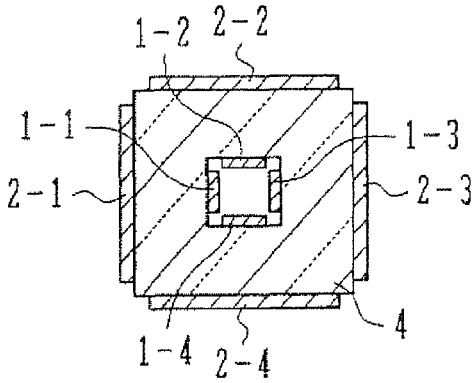

FIG. 2B shows a first configuration realizing the transmission line shown in FIG. 2A. A dielectric block 4 is made of dielectric having a high dielectric constant such as magnesium oxide, lanthanum aluminate and sapphire, and has an inner hole in the central area thereof. The inner hole has a rectangular prism shape of a quadrilateral in cross section. Four oxide superconductor layers 2-1, 2-2, 2-3 and 2-4 are formed on the outer peripheral surfaces of the dielectric block 4, and four oxide superconductor layers 1-1, 1-2, 1-3 and 1-4 are also formed on the inner walls of the inner hole of a quadrilateral in cross section.

These oxide superconductor layers can be formed by coating oxide superconductor material layers on the outer peripheral surfaces of the dielectric block 4 and the inner walls of the inner hole, for example, by dip coating, sintering the oxide superconductive material layers at a high temperature, and thereafter removing each edge portion with a file, cutter or the like. The slit between adjacent oxide superconductor layers is preferably set narrower than to $\lambda/4$ to prevent leakage of an electric field. The film thickness is preferably set to 0.5 μm or thicker.

Figure 2C:
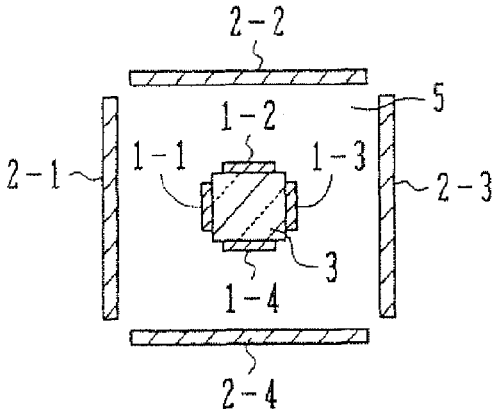
Figure 2D:
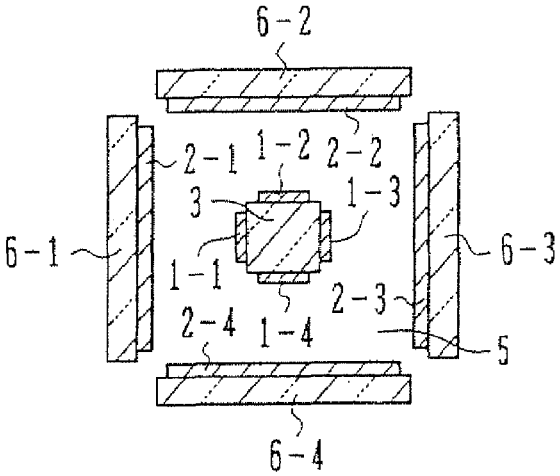

FIG. 2C shows another configuration realizing the structure shown in FIG. 2A. A central conductor is constituted of oxide superconductor layers 1-1, 1-2, 1-3 and 1-4 formed separately on four outer peripheral surfaces of an inner dielectric block 3 of a rectangular prism shape. These oxide superconductor layers can be formed by a method similar to that described with reference to FIGS. 1C and 1D. Surrounding the central conductor formed in this manner, oxide superconductor plates 2-1, 2-2, 2-3 and 2-4 are disposed facing the central conductor via an air gap 5 as shown in FIGS. 2C and 2D. A slit between adjacent oxide superconductor plates is set narrower than λ/4.

FIG. 2D shows a grounded external conductor of oxide superconductor made of oxide superconductor films formed on underlying substrates 6-1, 6-2, 6-3, and 6-4, similar to FIG. 1E. External conductors 2-1, 2-2, 2-3 and 2-4 are similar to the external conductors having the structure described with FIG. 1E. Central conductors 1-1, 1-2, 1-3 and 1-4 are similar to the central conductors described with FIG. 2C dispose on outer peripheral surfaces of an inter dielectric block 3 as in FIG. 2C as well.

Figure 3:
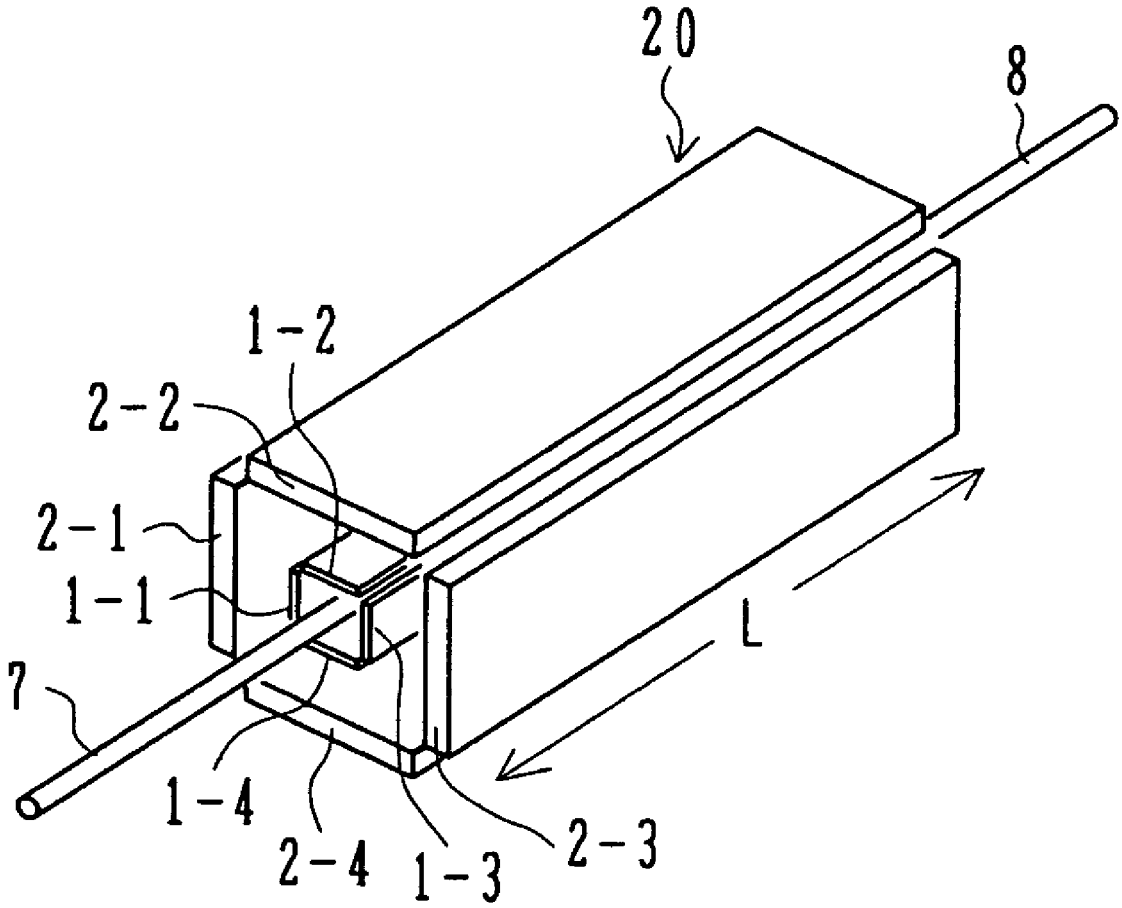
FIG. 3 is a perspective view showing an application example of the transmission lines shown in FIGS. 1A-1F and 2A-2D.
Figure 4A:
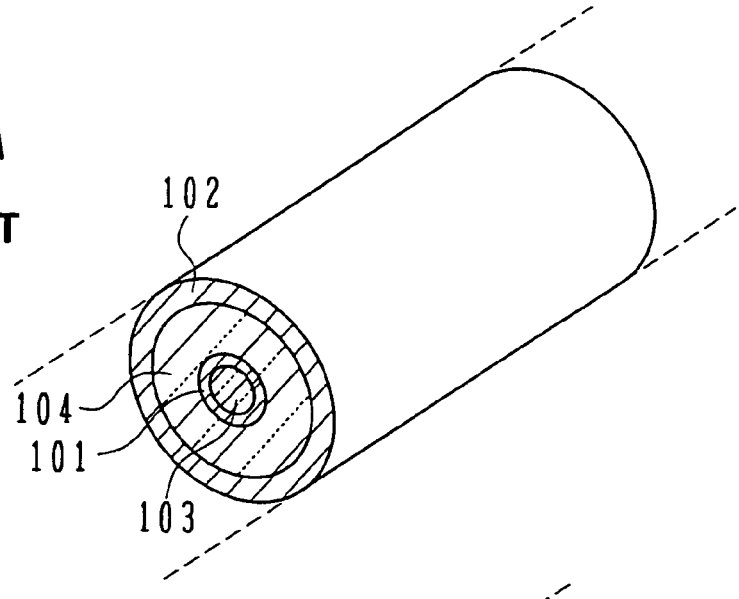
FIG. 4A PRIOR ART
FIGS. 4A, 4B, and 4C are perspective views showing the structures of transmission lines according to prior art.
Figure 4B:
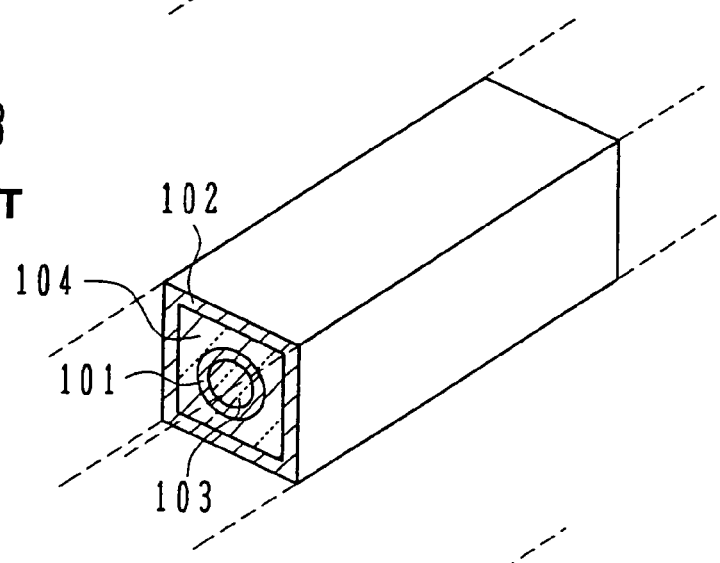
FIG. 4B PRIOR ART
Figure 4C:
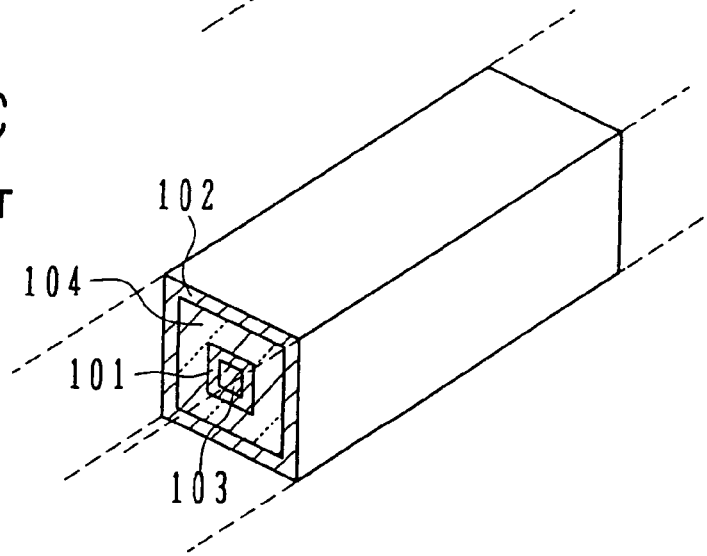
FIG. 4C PRIOR ART

FIG. 3 is a diagram showing an application example of a transmission line formed in the manner described above. A transmission line 20 is cut at a length L which determines a resonance frequency. A high frequency input probe 7 is disposed at one end of the transmission line 20, and a high frequency output probe 8 is disposed at the other end. A high frequency signal supplied from the high frequency input probe 7 to the transmission line 20 is passed through the resonator having the length L and coupled to the high frequency output probe 8. This structure can be used for the following applications. The remaining reference numbers labeled in FIG. 3 pertain to features described with respect to previous drawing figures, and further description of these reference numbers is omitted with respect to the description of FIG. 3.

(1) Transmission Cable (Wire Cable)

The transmission cable includes a cable for transferring a signal at high speed and low loss between semiconductor devices and a cable for supplying a large electric power (DC to AC) at low loss. Because the slit narrower than λ/4 is formed between the edge portions of adjacent planes, the conductor is made of epitaxial superconductor films without any crystal grain boundaries and a cable can be realized having a low loss and being able to flow large current. For example, in high frequency transmission at 1 GH, a loss can be reduced by about 1/100 the conventional loss. If the cross section has a rectangular shape, an electromagnetic field, current, stress and the like concentrate upon four corners. These can also be mitigated by forming the slits at the four corners. Current flows in the surface layer of the central conductor on the grounded external conductor side (the surface layer of superconductor is about twice a magnetic penetration depth, and hardly depends upon frequency), and flows in the surface layer of the grounded external conductor on the central conductor side (the surface layer of superconductor is about twice a magnetic penetration depth, and hardly depends upon frequency). Therefore, a metal layer or the like may be formed inside the central conductor or outside the grounded external conductor, for the purpose of protection and thermal load reduction during quenching.

(2) Current Limiter

Because of expansion of the scale of electric power, an increase in electric power demand, and an increase in networking and line capacity, failures of electric and electronic apparatuses are increasing due to a rapid current increase by accidents such as short circuits and thunder. As the countermeasures for these accidents, current limiters are under developments which pass electric power at no loss in a normal state and form a large impedance upon accidents to shut down accident current. One of the principles of a superconductive current limiter is a resistance transition type that transition from a superconductive state to a normal conductive state occurs to form a large impedance when an excessive current flows. In order to obtain good current limiter characteristics, it is essential that a superconductive critical temperature Tc and a superconductive critical current Ic are uniform in the whole area of superconductor. Since an epitaxial superconductor film without any crystal grain boundary can be formed uniformly in the whole area as described above, the current capacity can be increased and a high speed shut-down is possible. Although there is a fear of a large thermal load during current limit, this can be mitigated by forming a high thermal conduction layer of metal or the like inside the central conductor and outside the grounded external conductor. Devices shown in FIG. 3 may be connected in series and parallel to form a large capacity current limiter.

(3) Current Reed

A current reed made of copper has been used conventionally in the range from room temperature to 4 K level. However, a current reed made of copper has large Joule heat and a large inflow of heat from an external environment, resulting in the problem of an increased use amount of liquid helium and an increased size of refrigerator cooling magnet or the like. A superconductor current reed having a low loss and a small thermal conduction has been desired. However, if crystal grain boundaries or the like exist in oxide superconductor, the characteristics are degraded. With the configuration described earlier, an epitaxial superconductor film without any crystal grain boundary can be formed uniformly in the whole area. It is therefore possible to realize a current reed which has a low loss and a small inflow of heat, and can flow large current.

The present invention has been described in connection with the embodiments. The present invention is not limited only to the embodiments. For example, other materials may be used for the oxide superconductor, support substrate and dielectric block. It is obvious that other alterations, improvements, and combinations may be made by those skilled in the art.

What are claimed are:

1. A superconductor transmission line comprising:

an internal conductor; and an external conductor surrounding said internal conductor, comprising an oxide superconductor and having four planes, the four planes having a cross section of a hollow quadrilateral with each corner portion removed, each pair of adjacent planes of said four planes defining a slit narrower than λ/4, wherein λ is a wavelength of a high frequency wave to be transmitted.

2. The superconductor transmission line according to claim 1, wherein said oxide superconductor is one of Bi(Pb)—Sr—Ca—Cu—O, Y—Ba—Cu—O, and RE-Ba—Cu—O (RE: La, Nd, Sm, Eu, Gd, Dy, Er, Tm, Yb, Lu).

3. The superconductor transmission line according to claim 1, wherein said external conductor comprises an oxide superconductor layer having a thickness of at least 0.5 μm.

4. The superconductor transmission line according to claim 1, further comprising a dielectric block disposed in a region between said internal conductor and said external conductor.

5. The superconductor transmission line according to claim 4, wherein said dielectric block comprises a selected one of magnesium oxide, lanthanum aluminate and sapphire.

6. The superconductor transmission line according to claim 4, wherein said dielectric block has four flat external surfaces extending in a longitudinal direction and said external conductor is disposed on said four flat external surfaces.

7. The superconductor transmission line according to claim 4, wherein said dielectric block has an inner hole of a rectangular prism shape having four flat inner walls extending in a longitudinal direction, said internal conductor has four planes disposed on said four flat inner walls and is comprised of oxide superconductor, each pair of adjacent planes of said internal conductor defining a slit narrower than $\lambda/4$.

8. The superconductor transmission line according to claim 4, wherein said dielectric block has an inner hole of a circular cross section extending in a longitudinal direction and said internal conductor is inserted in said inner hole.

9. The superconductor transmission line according to claim 1, further comprising a respective support member for supporting each plane of the external conductor at an outer surface of said external conductor.

10. The superconductor transmission line according to claim 9, wherein said support member is comprised of one of magnesium oxide, lanthanum aluminate, sapphire, strontium oxide, cerium oxide, titanium oxide, silver, gold, nickel, nickel oxide and nickel alloy.

11. The superconductor transmission line according to claim 10, wherein said internal conductor is comprised of an oxide superconductor and has four planes, the four planes of the internal conductor having a cross section of a hollow quadrilateral with each corner portion being removed, and each pair of adjacent planes of the internal conductor defining a slit narrower than $\lambda/4$.

12. The superconductor transmission line according to claim 11, further comprising an inner dielectric block of a rectangular prism shape disposed inside said internal conductor wherein the four planes of said internal conductor are supported on outer surfaces of said inner dielectric block.

13. The superconductor transmission line according to claim 1, wherein said internal conductor and said external conductor constitute a resonator having a predetermined length.

14. A method of manufacturing an oxide superconductor transmission line, comprising the steps of:

(a) forming an oxide superconductor layer on outer surfaces of a dielectric block of a rectangular prism shape having a quadrilateral cross section; and (b) removing each corner portion of said rectangular prism shape dielectric block together with the oxide superconductor layer on the other surface of he dielectric block, thereby leaving four oxide superconductor layers on flat outer surfaces of said dielectric block, the four oxide superconductor layers being separated by slits narrower than $\lambda/4$, $\lambda$ is a wavelength of a high frequency wave to be transmitted.

15. The method of manufacturing an oxide superconductor transmission line according to claim 14, wherein said step (a) further comprises coating an oxide superconductor material layer on the outer peripheral surface of said dielectric block and sintering the coated oxide superconductor material layer.

16. The manufacture method for an oxide superconductor transmission line according to claim 14, wherein said step (a) forms the oxide superconductor layer on said dielectric block by sputtering or vapor deposition.

17. The manufacture method for an oxide superconductor transmission line according to claim 14, wherein said step (b) mechanically removes said oxide superconductor layer and said dielectric block.

18. A manufacture method for an oxide superconductor transmission line, comprising the steps of:

(a) preparing a dielectric block of a rectangular prism shape having a quadrilateral cross section with each corner portion being chamfered at a width narrower than $\lambda/4$, wherein $\lambda$ is a wavelength of a high frequency wave to be transmitted;

(b) coating an oxide superconductor material layer on flat outer surfaces of said rectangular prism shape dielectric block; and (c) sintering the coated oxide superconductor material layer.

* * * * *

UNITED STATES PATENT AND TRADEMARK OFFICE

CERTIFICATE OF CORRECTION

PATENT NO. : 7,263,392 B2
APPLICATION NO. : 11/203956
DATED : August 28, 2007
INVENTOR(S) : Akihiko Akasegawa et al.

It is certified that error appears in the above-identified patent and that said Letters Patent is hereby corrected as shown below:

Title Page, Item (54) Title: change "SUPERCONDUCTOR TRANSMISSION LINE HAVING SLITS OF LESS THAN λ\4" to --SUPERCONDUCTOR TRANSMISSION LINE--.

Column 1, Line 1 (Title), change "SUPERCONDUCTOR TRANSMISSION LINE HAVING SLITS OF LESS THAN λ\4" to --SUPERCONDUCTOR TRANSMISSION LINE--.

Column 3, Line 8, change "42-1," to --2-1,--.

Column 3, Line 11, change "42-1," to --2-1,--.

Column 3, Line 37, change "(where" to --where--.

Column 3, Line 43, change "allow large current," to --allow a large current flow,--.

Column 8, Line 6, change "he" to --the--.

Column 8, Line 10, after "λ\4," insert --wherein--.

Signed and Sealed this

Fourth Day of March, 2008

JON W. DUDAS
*Director of the United States Patent and Trademark Office*